US006016760A

United States Patent [19]

Menegatos

[11] Patent Number: 6,016,760

[45] **Date of Patent: *Jan. 25, 2000**

[54] SHIP FOR SELLING GOODS AND SUPPLYING SERVICES

[76] Inventor: Panagiotis Menegatos, 44, Xenofodos Street, GR-166 73 Voula Attikis, Greece

[ * ] Notice: This patent issued on a continued prosecution application filed under 37 CFR 1.53(d), and is subject to the twenty year patent term provisions of 35 U.S.C. 154(a)(2).

[21] Appl. No.: 08/673,079

[22] Filed: Jul. 2, 1996

Related U.S. Application Data

[63] Continuation-in-part of application No. PCT/GR95/00021, Oct. 23, 1995.

[30] Foreign Application Priority Data

Nov. 3, 1994 [GR] Greece ..... 940100495

[51] Int. Cl.[7] ..... B63B 3/00

[52] U.S. Cl. ..... 114/65

[58] Field of Search ..... 114/70, 65 R, 114/71, 72, 73, 270

[56] References Cited

U.S. PATENT DOCUMENTS

| | | | |
|---|---|---|---|
| 258,803 | 5/1882 | Phinney | 114/72 |
| 3,934,532 | 1/1976 | Bylo | 114/72 |
| 4,072,120 | 2/1978 | Bylo | 114/72 |

FOREIGN PATENT DOCUMENTS

| | | | |
|---|---|---|---|
| 725723 | 5/1932 | France . | |
| 3524418 | 1/1987 | Germany | 114/264 |
| 249588 | 10/1989 | Japan | 114/264 |
| 169440 | 5/1922 | United Kingdom . | |
| 283818 | 2/1928 | United Kingdom . | |

*Primary Examiner*—Stephen Avila
*Attorney, Agent, or Firm*—Ladas & Parry

[57] ABSTRACT

The ship for selling goods and suppling services is a new product of naval industry after the proper formation regulation and arrangement of the interior areas and the accesses to those areas of any kind of ship, either from the original construction or with the convertion after being constructed, on the purpose to give to the ship new functions, those of selling any kind of goods or/and suppling any kind of services selected in every case separately, in the ship, to the population of the islands coastal and riverside places as well as to the population of the hinterland of those places in the port of which the ship periodically moorings, securing the sufficiency and variety of goods or/and services.

7 Claims, No Drawings

SHIP FOR SELLING GOODS AND SUPPLYING SERVICES

This application is a continuation-in-part of copending application International Application PCT/GR95/00021 filed on Oct. 23, 1995 and which designated the U.S. and has priority to GR40/00495, filed Nov. 3, 1994.

FIELD OF INVENTION

The invention refers to the use of any ship, the whole of which or a selected part of its areas, is formed, arranged and adapted into areas proper for the new functions. These new functions consist of selling in said areas any kind of goods and/or of offering any services.

BACKGROUND OF THE INVENTION

In said areas is installed the necessary equipment for any new function. The use of the said ship is known from the patent descriptions FR-A-725723 and GB-A-283818. This use consists of the utilization of the said areas of the ship and the equipment, which is installed in those areas, during the temporary sojourn of the ship in the ports, for selling any kind of goods and/or supplying any services to traders-dealers, to any kind of commercial enterprises, to consumers and/or users of services correspondingly, who are settled down in the islands, in the coastal and riverside places.

The invention consists of specializing this known use of the said ship in order to give an alternate solution to the existing problem of the local lack of goods selling and/or services supplying units, in islands, in coastal and riverside places as well as in the hinterland of those places, in which due to special conditions the construction, equipment and operation of goods selling and/or supplying services local units is difficult to be done.

In fact, in islands, shore and riverside districts, in the hinterland of these areas, where the permanently living population is small, or in areas where great seasonal fluctuation of temporarily living there people is observed, there is a lack of local established goods selling and/or services offering units. This is due mainly to the disproportionately great cost for the construction, equipment and running of such units in relation to the small number of stable population. Also, where the local or sublocal road, railroad or coastal ship network connecting a larger geographical part of islands, shore and riverside areas between them or with the nearest to those areas urban centers, is non-existent or inadequate and hard to be used. In these cases, it is not feasible to establish in those areas local units for selling goods and/or for offering services in suitable places of those areas, which units will address to a larger number of population but also to traders-dealers and commercial enterprises of these areas.

Due to the lack of such local establishment of goods selling and services offering units, a lack of sufficiency or of a variety of goods and/or services in these areas is observed.

These lacks constitute one of the two main reasons, which lead the local population of these districts to emigrate to urban centers with the distressing result of abandonment of many geographical areas and in gradual disappearance of the productive activities traditionally exerted by the local population in those areas.

Also, the permanently or temporarily living population in these regions wishing to be provided with goods or to be supplied with services has to be involved in time-consuming travels going and coming to and from urban centers. The lack of local goods selling or services offering units in these regions, which can have considerable touristic activity, constitutes a restraining factor of this activity.

There exist descriptions of ships, whose areas are, as the case may be, formed, arranged and adapted into areas adequate for the new functions of selling any kind of goods and/or of supplying any services. These areas are equipped with all necessary for these new functions equipment.

The use of the said ship in those descriptions consists of the utilization of the said properly formatted, arranged and adapted areas of the said ship and the equipment, which is installed in those areas, for selling any goods and/or supplying any services, during the sojourn of the ship in the harbours, to the population, who are in the districts of these harbours.

These descriptions are included in the patents FR-A-725723 dated May 17, 1932 and GB-A-283818 dated Feb. 9, 1928.

The use of said ships as described in these patents, is not directed and cannot-achieve an alternative solution to the problem of lack of local goods selling and services supplying units, in the islands, in shore and riverside areas and in the inland of said districts, where the above mentioned special conditions are prevailing. These conditions make the construction, equipment and operation of the local established said units difficult. The utilization of the said areas of the ship and the equipment, proper for the new functions, which is installed in those areas, takes place in any port of islands, riverside and coastal places, in which the corresponding lacks in the said units are more or less dissimilar, having as result the partial and casual covering of these lacks in the said units.

Also, the temporary sojourn of the said ship in the ports is not an alternate solution to these lacks in local units, because of the temporary, not repeated periodically, so without duration covering of the said lacks during the temporary sojourn of the said ship in the ports.

SUMMARY OF THE INVENTION

The specialized use of the said ship, which characterizes the present invention consists of the periodicity of its temporary sojourn in the ports, which are chosen in each case, so as to form a subtotal of at least two ports of the total of all existing ports. The frequency of the periodical sojourn of the said ship in each of these ports is chosen to fit to each individual case.

Also, the specialized use of the said ship consists of the periodicity of the utilization of the properly formatted, arranged and adapted areas of the said ship and of the installed in those areas equipment during the periodical sojourn of the ship in each of those ports, belonging to the separately chosen in each case subtotal of ports, for selling goods and/or supplying services to traders-dealers, to any kind of commercial enterprises, to consumers and/or users of services correspondingly, who are either permanently or temporarily settled down in the islands, in the coastal and riverside places as well as in the hinterland of those places, in the ports of which the said ship sojourns periodically.

The frequency of the periodical utilization of the said areas of the ship in each port, is chosen to fit to each individual case.

DETAILED DESCRIPTION

In order that this specialized use of the ship has the best possible results, the ports constituting the above mentioned chosen subtotal, must be ports of areas that have similar lacks of goods selling and/or of service offering local units, in the greatest possible extent, for the operation of which areas and equipment-similar to those existing in the ship would be needed. In this way the use of the ship will greatly cover this local absence of said units and the specially formed, arranged and equipped areas of the ship as well as the installed equipment in the said areas, will fulfil the task in all ports of the selected subtotal in the best and most efficient way.

It is possible that the selection of the ports, which make a certain subtotal, in which the specialized use of the ship will be carried out, precedes the appropriate forming and arrangement of the areas of the ship and the installation of the necessary equipment.

In this way the actual and concrete lacks of goods selling and/or service supplying units in the islands, riverside and coastal areas and in the inland of these areas of those selected ports can be taken into consideration and the corresponding lacks in selling goods and/or supplying services units will be better covered. The use of the ship in this way will be optimized in the certain subtotal of ports. The above does not exclude the existence of other ports in islands, coastal and riverside regions, which could form different subtotals and the lacks of which in said units are more or less similar to those of the initially chosen subtotal. In these different subtotals the specialized use of the ship will also be possible and it will cover their said lacks in units to a great extent. The total number of ports constituting a subtotal, in which the special use of the ship will take place, and the distances between them should be chosen based on the criteria of the shortest possible distances between them and the greatest possible frequency and duration of the specialized use of the ship in these ports.

In the case in which only a part of the areas of the ship is being formed, arranged, adapted and equipped so as to be appropriate for selling goods and/or supplying services as mentioned, the remaining unused areas of the ship can be utilized for the placement of passengers, vehicles or merchandise, in order to transport them with the moving of this ship between the ports forming the said subtotal, in which the specialized use of the ship will take place, so as to give to the ship the additional task of connecting these ports by a coastal line.

The advantage of the present invention is based on the fact that, while maintaining the advantage of the known from the description of patents FR-A-725723 and GB-A-183818, use of the said ship consisting of the utilization of the properly for selling goods and/or supplying services formatted, regulated and adapted areas of the ship and of the equipment, which is installed in those areas, during the temporary sojourn of the ship in the ports so as to address to a larger number of consumers and/or users of services than that of a local unit, the specialized inventive use offers an alternative solution to the problem of lack of goods selling and/or services supplying units in islands, in coastal and riverside areas and their inland, where the said existing conditions lead to the lack of local constructed, equipped and operated units, because of the periodicity of the sojourn and the periodicity of the utilization of the said areas of the ship and of the equipment, which is installed in those areas, covering almost permanently these lacks. The specialized inventive use of the ship is more efficient, because it takes place in a selected subtotal of harbours having similar lacks in goods selling and/or service supplying units, for the operation of which spaces arranged and equipped similarly to the ones of the ship would have been needed. One more advantage is the more complete utilization of the ship's spaces, which have been arranged and formed into adequate rooms for selling goods and/or for offering services, and the more efficient employment of the equipment installed in them during the sojourn of the ship in each selected harbour of said subtotal, because of the possibility to form subtotals of ports in which the specialized use of the ship takes place belonging to areas with similar lacks of the said local units.

In the case in which only a part of the areas of the ship is being formed, arranged, adapted and equipped so as to be appropriate for selling goods and/or supplying services and the remaining areas of the ship are utilized for the placement of passengers, vehicles and merchandise, which are transported with the moving of the ship between the selected subtotal of ports, in which the specialized use of the ship takes place, another advantage is the ability of the said ship to connect these ports by a coastal line, avoiding thus the use of another ship for only this purpose.

The invention consists in giving to any kind of ship new functions, with the proper formation, regulation and arrangement, of its interior areas and the accesses to those areas. These functions are those of selling goods or/and suppling services in the ship, periodically, to traders-dealers, to any kind of commercial enterprises, consumers and/or users of services, correspondingly, in the islands, in the coastal and riverside places as well as in the hinterland of those places, into the ports of which the ship moors periodically. In the islands, in the coastal and riverside places, but also in the hinterland of those places, where the permanent population is low and where seasonal fluctuation is vast or very often the road and the railboard net which connects them with the big urban centers is inadequate or difficult to use, there is a remarkable lack of plenty and variety of goods even in indispensable goods. This is due to the lack of big local units of selling goods, mainly because the permanent population is low and there is a disproportionaly high cost of settlement and function of those units. The same phenomenon of lack, for the same reasons, is noted in private or public services. This lack of goods and services leads to the phenomenon of immigration of the local population to the big urban centers and the desertion of those areas. Also, it leads to the purposeless and the timeless movements of the population of those areas to the big urban centers for buying goods and being supplied by services. The lack of plenty and variety of goods, during the time of seasonal population rise, acts as a kind of break for the touristic development of those areas. Also, the conditions under which the goods are stored and preserved, especially food stuff are not appropriate because of long storage in inadequate places, because of low seasonal consumption. The ship for selling goods and supplying services is one whole or in part is provided with new functions on a case-by-case basis. Those functions of selling any kind of goods and/or supplying any kind of services, chosen in every case separately, in the entire of the ship, or in a part of it, to traders-dealers, to any kind of commercial enterprises, to consumers and/or users of services correspondingly, who are either permanently or periodically settled down in islands, in coastal and riverside places, as well as in the hinterland of those places, during the time of the ship's periodical mooring in the port of those areas, which frequency and duration is selected on a case-by-case basis.

These new functions are given to any kind of ship regardless of its type, dimensions and tonnage, with the proper formation, regulation and arrangement of the interior areas of it and the accesses to those areas, either through original construction or conversion after construction. The entire or part of the ship are provided with new functions on a case-by-case basis. The remaining part of it can be used for every kind of other functions chosen in every case separately. In order to customize a ship for new functions, it is necessary for every ship separately to have the proper formation, regulation and arrangement of its interior areas, and the accesses to those areas. The entire or of a selected part of the ship is given new functions. Every new function that is given to any kind of ship requires the proper regulation, formation and arrangement of the interior areas, in which every new function takes place, as well as the setting in it, of any necessary, appropriate, stable or movable equipment, selected in every case separately for every new function. Some of the goods that could be sold in the ship, are super-market items, clothing, electric and electronic equipments, furniture or any kind of other goods, selected to be sold in every case separately. As far as services, some that can be supplied in the ship are: Services of Engineer, Agricalturist, Veterinary-surgeon, Doctor of different specialty, small surgical units, libraries, schools and and public services annexes or any other services choosed in each case separately. The advantage of the ship for selling goods and supplying services is that goods are sold and/or services are supplied to traders-dealers, to any kind of commercial enterprises, to consumers or/and users of services periodically, in islands, in coastal and riverside places, as well as in the hinterland of those places, in ports of which the ship moors periodically, with sufficiency and variety. The ship can service an entire population where local settlements of units of such a size was impossible because of the small size of the permanently settled down population and the disproportionately high cost of establishment and working of these units. The existense of goods and services in variety and sufficiency will become the motive for development of the islands, coastal and riverside places as well as for the hinterland of those places.

It will contribute to their touristic substructure, it will reduce the immigration to urban centers, as well as removal of the permanently settled down population to urban centers to acquire goods and services. The ship provides new functions of selling any kind of goods and/or supplying any kind of services, selected on a case-by-case basis to be sold and/or supplied correspondingly in the entire of the ship or in a selected part of it, periodically, to traders-dealers, to any kind of commercial enterprises, to consumers or/and users of those services correspondingly, in the islands, in the coastal and riverside places, as well as in the hinterland of those places, in the ports of which the ship periodically moors. The functions are given to any kind of ship that is going to engage in selling goods and supplying services with the proper formation, regulation and arrangement either through original construction or conversion after being constructed of the entire of the interior areas of the ship and the accesses to those areas. The ship is customized for every new function with stable or movable equipment selected on a case-by-case basis considering the following:

a) The kind of goods and/or services that will be sold and/or supplied in the ship.

b) The type, tonnage, dimensions and the number of the decks of ship.

c) The total number of goods and services receivers.

d) The number of ports in which the ship will moor periodically.

e) The duration of the mooring in every port.

f) The frequency of its mooring in every port.

g) The number and the specialty of the ship.

As an example we can take the formation, regulation and arrangement of the interior areas of a ferry- boat consisting of three decks, in the entire of which we can give the new functions of selling goods and supplying services selected for this case. The deck that up to now was used for the transfer of vehicles can be formatted, regulated and arranged as a place to store and sell goods and different sorts of super-market items, because this place is more available to the public by ramp. The deck over it, can be used to sell clothing, electric and electronical equipment and furniture. The third one can be used for areas of supplying services, establishing offices of lawyers, doctors, veterinary-surgeons, engineers, annexes of public services, as well as areas for that work in the ship. For ships with bigger or less tonnage it is possible to add or to deduct goods for selling and services for supplying correspondingly.

Also the existence of more or fewer decks in the ship provide a basis for altering the functions that are referred in the example for every ships deck.

It is obvious that the formation, regulation and arrangement of the interior areas and the accesses to those areas of any kind of ship for the purpose to give to it the selected, in every case separately, new functions of selling goods and/or supplying services demands study and construction for every ship separately by properly specialized, scientific and technique personnel.

I claim:

1. A method for supplying goods or services to a plurality of markets with a ship comprising:

(a) identifying a plurality of ports having respective populations with a need for the same goods or services by screening a larger number of ports to ascertain a need for establishments providing the goods or services, said screening being used to determine: (i) the number of ports at which the ship moors periodically; (ii) the duration of mooring at each port; (iii) the periodicity of mooring at each port; (iv) a quantity or quality of the goods or services, and (v) the type, tonnage or dimensions of the ship, or the number of decks on the ship;

(b) providing the ship with means for dispensing said same goods or services to the respective populations in discrete areas on the ship; and (c) mooring the ship at a first of the plurality of ports, providing traders-dealers, commercial enterprises, consumers or users of services in the population of said first port with access to said discrete areas and dispensing said same goods or services to said members in said discrete areas; and (d) periodically shuttling the ship between the first port and another of the plurality of ports and mooring the ship at the other port for a time sufficient to provide consumers in the population of said other port with access to said discrete areas, and dispensing said goods or services to the consumers in said discrete areas.

2. A method for supplying goods or services to traders-dealers, commercial enterprises, consumers or users of services in respective populations of a plurality of ports, said method comprising:

a) identifying, by screening a larger number of ports, a plurality of at least two ports with the same need in establishments providing goods or services to the traders-dealers, commercial enterprises, consumers or users of services in the respective populations, said screening comprising identifying in which of the larger number of ports said establishments are needed and selecting said at least two ports on at least this basis;

(b) providing a ship with discrete areas which are adapted properly for dispensing the goods or services provided in the establishments; and (c) periodically shuttling the ship between and mooring the ship in the at least two ports for a time sufficient in each port to provide the goods or services to the traders-dealers, commercial enterprises, consumers or users of services in the respective populations in the discrete areas of the ship.

3. A method as claimed in claim 2, wherein the screening is used to determine the goods or services provided in the discrete areas of the ship, and their quantity and quality.

4. A method as claimed in claim 2, comprising identifying more ports with a need for the establishments providing the goods or services and periodically providing respective populations of the more ports with the goods or services in the adapted areas of the ship.

5. A method for adapting a ship for dispensing goods or services, during the sojourn—mooring of the ship in ports, to traders-dealers, commercial enterprises, consumers or users of services in the respective populations of the ports, said method comprising:

a) identifying, by screening a larger number of ports, a plurality of at least two ports with the same need for establishments which dispense goods or services to the respective populations, said screening comprising identifying in which of the larger number of ports said establishments are needed and selecting said at least two ports at least on this basis;

(b) adapting discrete decks of the ship to adapted areas proper for dispensing the goods or services dispensed in said establishments to the respective populations of the plurality of ports identified in step (a).

6. A method as claimed in claim 5, further comprising periodically shuttling the ship between and sojourn-mooring the ship in the at least two ports for a time sufficient in each port to provide the goods or services to the traders-dealers, commercial enterprises, consumers or users of services in the respective populations in the adapted areas of the ship.

7. A method as claimed in claim 6, comprising identifying more ports with a need for the establishments which dispense the goods or services needed by the plurality of at least two ports identified in step (a).

* * * * *